United States Patent [19]

Johnson

[11] 4,252,393

[45] Feb. 24, 1981

[54] ELECTRICAL CONNECTOR FOR STRIP CONDUCTORS

[75] Inventor: Donald L. Johnson, Olivenhain, Calif.

[73] Assignee: Teledyne Industries, Inc., Los Angeles, Calif.

[21] Appl. No.: 64,003

[22] Filed: Aug. 6, 1979

[51] Int. Cl.[3] ..... H01R 13/62

[52] U.S. Cl. ..... 339/75 MP; 339/17 F; 339/91 R; 339/176 MF

[58] Field of Search ..... 339/17 F, 75 R, 75 M, 339/75 MP, 91 R, 176 MF

[56] References Cited

U.S. PATENT DOCUMENTS

| | | | |
|---|---|---|---|
| 3,750,085 | 7/1973 | Cooper | 339/75 M |
| 3,883,207 | 5/1975 | Tomkiewicz | 339/75 M |
| 3,989,336 | 11/1976 | Rizzio, Jr. et al. | 339/17 F |
| 4,076,362 | 2/1978 | Ichimura | 339/75 MP |

*Primary Examiner*—John McQuade

[57] ABSTRACT

A connector for making electrical connection to a flexible conductor cable is disclosed which includes a block member having a first surface and a plurality of resilient electrical contact members projecting from the block member. Each of the contact members includes a portion substantially parallel to the first surface of the block member which terminates in a free end, with the parallel portions of the contact members and the first surface of the block member defining a space for receiving a flexible conductor cable to which electrical contact is to be made. The connector further includes a cover member having an inner surface. The cover member and block member are affixed together in such a manner that the inner surface of the cover member depresses the contact members in the direction of the first surface of the block member, whereby the free ends of the contact members exert a spring force against any flexible conductor cable inserted in the defined cable receiving space to make electrical contact with the flexible conductor cable and to hold the flexible conductor cable securely in the electrical connector.

7 Claims, 5 Drawing Figures

ELECTRICAL CONNECTOR FOR STRIP CONDUCTORS

BACKGROUND OF THE INVENTION

The background of the invention will be discussed in two parts:

1. Field of the Invention

This invention relates to electrical connectors and more particularly to an electrical connector for making contact to a strip conductor carrying a number of individual conductors.

2. Description of the Prior Art

Many uses have been found in the prior art for flexible flat conductor cables which carry a multiplicity of individual conductors aligned in parallel. Such cables often furnish the connections to a printed circuit board or the like. Various means have been designed for connecting such flexible conductor cables to particular electrical circuits. Among these are connectors which require that substantial force be exerted on the flat conductor cable when it is inserted into the connector. Since such forces tend to generate electrical faults, it is desirable that such insertion forces be reduced or eliminated.

All such connectors have as a design criteria that each of the conductors in the cable be positively conductively connected by the connector both initially and throughout the operation of the circuits. Various prior art connectors have operated to provide effective conductive connection to such circuits in particular environmental situations. However, many connectors of the prior art cannot maintain positive connection to all conductors of a flexible strip cable in extreme environmental conditions, and consequently, intermittant operation or failure of the circuits may occur.

Circuits utilizing flexible strip cables are often subject to substantial environmental changes which cause mechanical forces to be applied that tend to distort the connectors. For example, changes in temperature, altitude, humidity, and the like may all affect the structure of a connector and the forces applied thereto and tend to distort and disturb the electrical connections made by such connector.

It is an object of the present invention to provide a new and improved zero insertion force connector for mass connection of the conductors in a multiple strip conductor cable to printed circuit boards of the like.

It is another object of the present invention to provide a connector for flexible multiple conductor cables which will maintain a firm electrical connection to each of the conductors of a cable in the face of substantial environmental variations.

It is yet another object of this invention to provide a connector for multiple conductor cables which exhibits little tendency to distort in the face of environmental changes and shocks.

SUMMARY OF THE INVENTION

The foregoing and other objects of the invention are accomplished by a two-piece connector which includes a first rectangular block body member constructed of dielectrical material and having a first surface. The body member mounts a series of parallel resilient electrical contacts each of which projects from the block at a right angle to the first surface. The projecting contacts are all bent as they exit the block to lie essentially parallel to each other and to the first surface of the block.

The block has a pair of essentially cubic notches or indentations cut in the two corners of a surface opposite that from which the terminals project. The block also has a serrated edge at a lower surface of the end opposite the cubic notches.

The second portion of the connector is essentially a cover having a pair of projections at one end adapted to mate with the cubic indentations in the block and a pointed projection at the other end adapted to mate with the serrations. The inside of the cover contains a surface adapted to bend the resilient contacts downwardly into contact with the first surface of the block.

To join the two portions of the connector, the cover is brought into position over the terminals so that the cubic projections mate with the cubic indentations in the block. The cover is pivoted about the projections to a first position in the serrations. In this position, the inside surface of the cover presses against and depresses the resilient contacts so that they lie slightly separated from the first surface of the body. The spring tension of the contacts pressing against the innner surface of the cover helps to maintain the two portions of the connector in this first position firmly affixed one to the other for handling, shipping, and mounting on a printed circuit board or the like.

In this first position, the free ends of the contacts lie nestled behind a slight step on the inner surface of the cover so that a multiple conductor flat cable may be inserted between the first surface of the block and the cover without disturbing the contacts. Depressing the cover further causes the pointed projection of the cover to mate in a second position with the serrated projections on the lower edge of the block and firmly lock the cover in a second position relative to the block. Depressing the cover forces its inner surface to depress the contacts firmly against the conductors of the flat strip cable at a conical point on the free end of each terminal, providing high point loading. In the second and locking position of that connector, an edge of the inner surface of the conductor depresses the central portion of each resilient contact to provide a very high force at the conical point at the free end of each contact. The cover thus provides a positive lock so that the conductor cable cannot be pulled out of electrical contact with the contacts mounted on the block by any forces likely to be encountered in use of the connector.

Other objects, features, and advantages of the invention will become apparent from a reading of the specification when taken in conjunction with the drawings, in which like reference numerals refer to like elements in the several views.

DESCRIPTION OF THE PREFERRED EMBODIMENT

Figure 1:
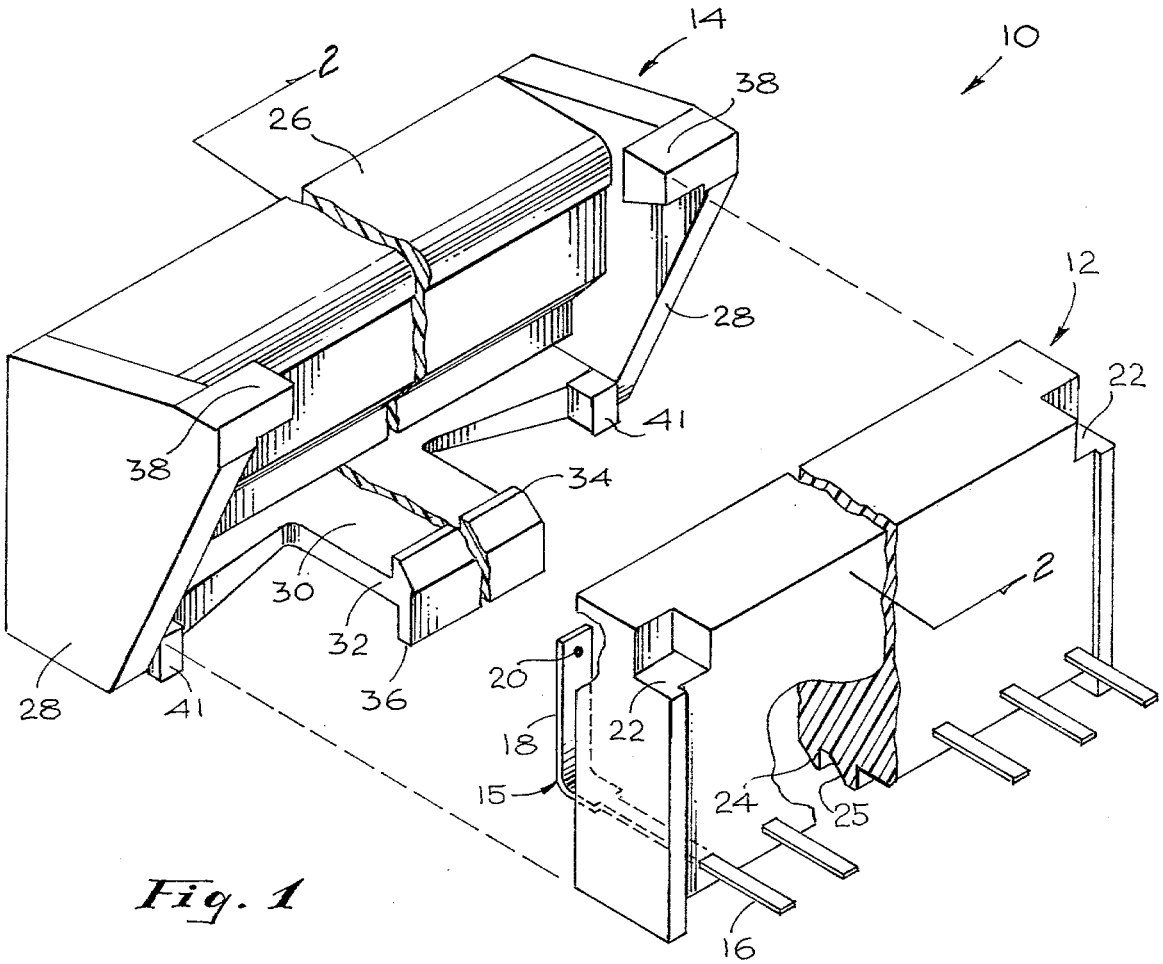
FIG. 1 is a perspective view showing a two-part connector constructed in accordance with the invention.
Figure 2:
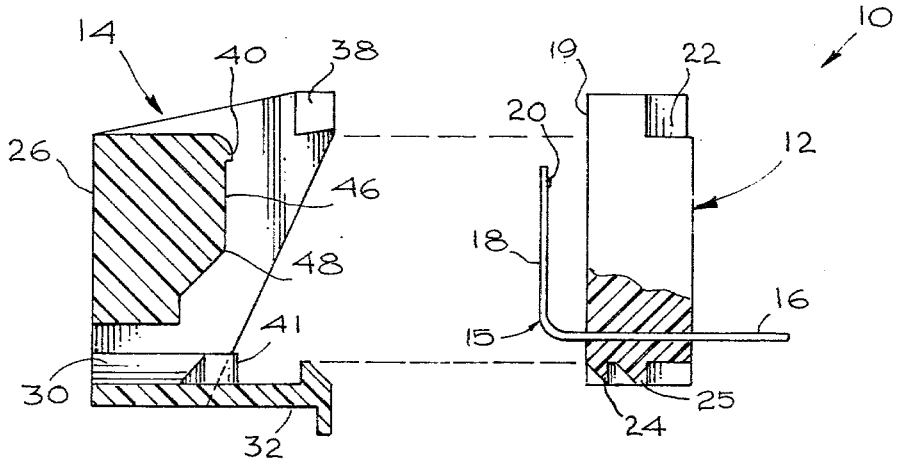
FIG. 2 is a cross-sectional view taken along the lines 2—2 of FIG. 1.

Referring now to the drawings and more particularly to FIGS. 1 and 2, there is shown in perspective view a connector 10 comprised of a first portion 12 which is a generally-rectangular block and a second portion 14 which is a cover. The block 12 and the cover 14 may be manufactured by well known techniques from thermoplastic or thermal setting plastic materials or from some other dielectric material selected for the particular environmental conditions to which the connector is to be subject. The block 12, although shown as rectangular, may be physically connected to or be a part of a printed circuit board or other electrical circuit (not shown). The block 12 has imbedded therein a series of parallel resilient contact elements or conductors 15 which may be attached at their right ends 16 (as shown in FIG. 1) to additional circuitry (not shown). The contacts 15 are fixed in place by the block 12 so that their left ends protrude at a substantially right angle to the back surface 19 of the block 12. The left ends 18 of the contacts 15 are bent at essentially a right angle as they exit from the block 12 and terminate in a series of parallel cantilevered beam portions 18. The upper or free end of each of the cantilevered beam portions 18 of the contacts 15 is positioned a sufficient distance from the back surface 19 of the block 12 that a multiple conductor cable may be inserted therebetween. The free end of each contact 15 may have a contact point 20 on its surface adjacent the surface of the block 12.

The block 12 has a pair of essentially cubic indentations or notches 22 in its upper frontal corners. The lower surface of the block 12 carries first and second saw-tooth serrations 24 and 25 respectively. The indentations 22 and the serrations 24 and 25 are utilized in latching the cover 14 to the block 12.

The cover 14 includes a first transverse section 26 which supports two parallelly disposed end members 28. As may be seen in FIG. 2, the section 26 of the cover 14 is of sufficient dimension to oppose any bending or warpage which might be caused by the spring action of the contacts 15 which is described below. The lower portion of each member 28 is joined at a right angle to a bottom member 30 which has a latching finger 32 extending therefrom with a projecting latch 34 adapted to mate with the saw-toothed serrations 24 and 25 of the block 12. An actuating mechanism 36 extends from the finger 32 below the latch 34 to aid in withdrawing the latch 34 from the serrations 24 and 25.

Each of the end members 28 of the cover 14 mounts an inwardly projecting block 38 adapted to fit into the indentations 22 of the block 12. The blocks 38 may have a lower surface which slopes from right to left as seen in FIGS. 1 and 2 which is utilized in latching the cover 14 to the block 12, as is explained below. The cover 14 also includes a pair of stops 41 projecting inwardly from the end members 28 to preclude excess bending of the contacts 15 when the cover 14 is pressed against the block 12.

As is particularly shown in FIG. 2, the profile of the section 26 of the block 14 includes a surface 46 which faces the block 12. The front of surface 46 is generally flat but has a projection 40 at its upper end. The surface 46 bends at a corner 48 and tapers downwardly to the left therefrom.

Figure 3:
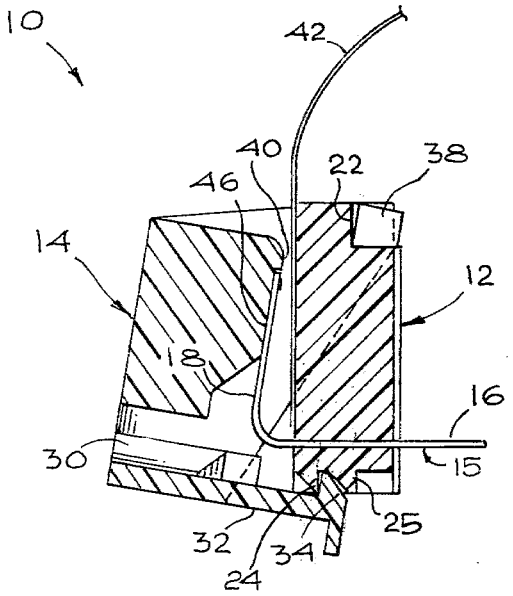
FIG. 3 is a cross-sectional view showing the two parts of the connector of FIG. 1 in a first joined position.

The block 12 and cover 14 are assembled by inserting blocks 38 into the indentations 22 and pressing the latch 32 into the first serration 24, as shown in FIG. 3. The lower tapered surfaces of the blocks 38 now lie against the bottom surface of the indentations 22. This places the cover 14 in a position so that the surface 46 bears against and lies tangent to the portions 18 of contacts 15. The ends of portions 18 in this position lie nestled beneath the projection 40 spaced away from the block 12 and exert a spring force back against the surface 46. Consequently, the two portions of the connector 10 remain firmly in this first position, in which they may be stored or shipped to a user.

The user of the connector 10 simply inserts a flexible strip conductor cable 42 into the top of connector 10, as shown in FIG. 3, into the space between the back surface 19 of block 12 and the portions 18 of contacts 15. The cable 42 slips freely in and out of this space while the connector 10 remains in this first position since the portions 18 are spaced apart from the back surface 19 of block 12 and their upper ends lie behind and are protected by the projection 40.

After the cable 42 is inserted into the connector 10, the user completes the assembly by pressing upon the right side of block 12 and the left side of cover 14. This causes the latch 34 to flex downwardly and slip into the second serration 25 and locks the cable 42 in place. This second position of the connector 10 is shown in FIG. 4.

Figure 5:
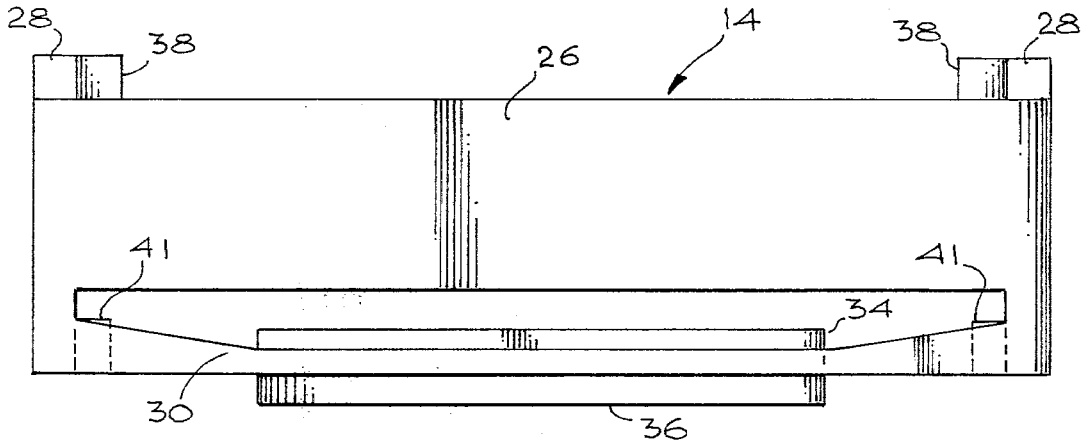

FIG. 5 illustrates the shape of the bottom member 30 which allows it to flex. Bottom member 30 thins inwardly from the end members 28 toward the finger 32. FIG. 1 also illustrates that bottom member 30 narrows as it nears the finger 32. This relatively complex shape allows the bottom member 30 to flex so that the latch 34 may move over the serrations 24 and 25 and fit in the locked second position without causing distortion of the section 26.

Figure 4:
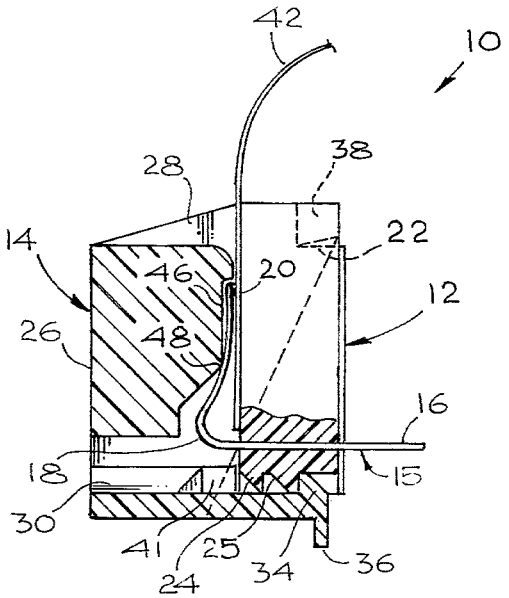
FIG. 4 is a cross-sectional view showing the two parts of the connector of FIG. 1 in a second locked position; and, FIG. 5 is a left side view of the cover portion of the connector of the previous Figures.

In the second or locked position shown in FIG. 4, the corner 48 of the section 26 applies substantially equal force to each of the portions 18 of the contacts 15. Corner 48 acts as a protrusion to depress the portions 18 and force the contact points 20 against the conductor cable 42. This force applied to portions 18 remains constant because of the manner of securing the cover 14 to the block 12 by the blocks 38, which fit positively into the indentations 22, and by the latch 34, which fits positively into the second position behind the serration 25. These two positive locks at opposite ends of the cover 14 oppose the spring forces from resilient contacts 15 upon the corner 48. The spring force upon corner 48 is the result of the spring force created at the bend of portions 18 of contacts 15 where they exit block 12 and the spring force applied at contact point 20. The high point loading force at contact points 20 is very substantial, and retains the conductor cable 42 securely in place.

It will be appreciated that the size of section 26 is sufficient to prevent its warpage even though a great number of contacts 15, each applying a substantial force, are used in the connector 10. Consequently, positive conductive connections are made and maintained by connector 10.

While there has been shown and described a preferred embodiment of the connector of the present invention, it is to be understood that various adaptations and modifications may be made within the spirit and scope of the invention. The invention is limited in scope only by the appended claims.

What is claimed is:

1. A connector for making electrical connection to a flexible conductor cable comprising, in combination:

a block member having a first surface;

a plurality of resilient electrical contact members projecting from the block member, each including a portion substantially parallel to the first surface of the block member and terminating in a free end, the parallel portions of the contact members and the first surface of the block member defining a space for receiving a flexible conductor cable to which electrical contact is to be made; and a cover member having an inner surface thereon, the cover member and block member including means for affixing the cover member to the block member comprising means for fixing one end of the cover member to pivot about one end of the block member, and means for fixing the end of the cover member opposite the one end thereof in a first position with respect to the end of the block member opposite the one end thereof in which the free ends of the contact members are spaced from the first surface of the block member to receive the flexible conductor cable in the defined space and for fixing the end of the cover member opposite the one end thereof in a second position with respect to the end of the block member opposite the one end thereof in which the free ends of the contact members are depressed towards the first surface of the block member to exert a spring force against any flexible conductor cable inserted in the defined cable receiving space to make electrical contact with the flexible conductor cable and to hold the flexible conductor cable securely in the electrical connector.

2. The electrical connector of claim 1 wherein the cover member comprises a relatively thick central section having the inner surface, a pair of side members positioned at opposite sides of the central section and transverse thereto, a flexible end wall joining the two side members at the ends thereof opposite the one end of the cover member, the flexible end wall being connected to the block member by the means for fixing the end of the cover member in first and second positions, and wherein the means for affixing one end of the cover member to pivot about one end of the block member includes pivotably connecting the side members to the block member.

3. The electrical connector of claim 2 wherein said means for fixing one end of the cover member to pivot about one end of the block member comprises a pair of projections, one from each of the side members, and a pair of indentations in the block member arranged to mate with the projections; and wherein said means for fixing the end of the cover member in first and second positions comprises a latch projecting from the flexible end wall and locking means for holding the latch in first and second positions on the end of the block member opposite the one end thereof.

4. The electrical connector of claim 3 in which the locking means comprises a first serration which engages the latch when the cover member is in the first position and a second serration which engages the latch when the cover member is in the second position.

5. The electrical connector of claim 2 in which the inner surface of the central section has a lip positioned to extend outward to protect the free ends of the contact members when the cover member has its end opposite the one end thereof in the first position.

6. A connector for making electrical connection to a flexible conductor cable comprising a block of dielectric material having a first surface, a plurality of parallel resilient electrical contact members embedded in the block and projecting therefrom, the contact members terminating in contact points and being bent as they exit the block to lie essentially parallel to the first surface, thereby providing cantilevered beam springs, a cover having a relatively thick central section with an inner surface, means for pivotably affixing one end of the cover to one end of the block so that the inner surface closes toward the first surface, means for fixing a second end of the cover opposite the one end in a first position relative to the block in which the inner surface depresses the contact members so that they lie tangent to the inner surface and exert spring pressure thereon but are apart from the first surface, and means for fixing the second end of the cover in a second position relative to the block in which the inner surface depresses the contact members between the point at which they exit the block and the contact points to force the contact points against anything lying between the contact points and the first surface.

7. The electrical connector of claim 6 in which the inner surface has a lip which protects the terminal ends of the contact members in the first position from damages by multiple conductor strip cables inserted between the contact members and the first surface.

* * * * *